US011668330B2

(12) United States Patent
Kinoshita et al.

(10) Patent No.: US 11,668,330 B2
(45) Date of Patent: Jun. 6, 2023

(54) HYDRAULIC DRIVE SYSTEM

(71) Applicant: KAWASAKI JUKOGYO KABUSHIKI KAISHA, Kobe (JP)

(72) Inventors: Nobuyuki Kinoshita, Kobe (JP); Akihiro Kondo, Kobe (JP); Naoki Hata, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/288,339

(22) PCT Filed: Dec. 10, 2019

(86) PCT No.: PCT/JP2019/048358
§ 371 (c)(1),
(2) Date: Apr. 23, 2021

(87) PCT Pub. No.: WO2020/145006
PCT Pub. Date: Jul. 16, 2020

(65) Prior Publication Data

US 2021/0381532 A1 Dec. 9, 2021

(30) Foreign Application Priority Data

Jan. 11, 2019 (JP) ..... JP2019-003451

(51) Int. Cl.
*F15B 15/20* (2006.01)
*F15B 15/02* (2006.01)

(52) U.S. Cl.
CPC ..... *F15B 15/202* (2013.01); *F15B 15/02* (2013.01)

(58) Field of Classification Search
CPC ..... F15B 15/02; F15B 13/01; E02F 9/2285
See application file for complete search history.

(56) References Cited

U.S. PATENT DOCUMENTS

| | | | | |
|---|---|---|---|---|
| 10,677,274 | B2 * | 6/2020 | Kondo | E02F 9/2292 |
| 2016/0032947 | A1 * | 2/2016 | Tanaka | E02F 3/435 60/429 |
| 2017/0166253 | A1 * | 6/2017 | Kondo | E02F 9/2296 |
| 2019/0316611 | A1 | 10/2019 | Kondo et al. | |

FOREIGN PATENT DOCUMENTS

| | | | |
|---|---|---|---|
| JP | 2010013855 | A | 1/2010 |
| JP | 2017110672 | A | 6/2017 |
| JP | 2018105333 | A | 7/2018 |
| WO | 2018117029 | A1 | 6/2018 |

* cited by examiner

*Primary Examiner* — Abiy Teka
(74) *Attorney, Agent, or Firm* — Alleman Hall Creasman & Tuttle LLP

(57) ABSTRACT

A hydraulic drive system raises and lowers an object by supplying and discharging operating oil to and from two ports of an actuator and includes a control device, first to fifth electromagnetic proportional control valves, first and second hydraulic pumps, a first and second control valve, and a lock valve. When a fourth pilot pressure is output, the second control valve causes the operating oil to be discharged from a first port in order to lower the object. The lock valve prevents the operating oil from being discharged from the first port by closing a path between the first port and the second control valve, and when a fifth pilot pressure is output from the fifth electromagnetic proportional control valve per an operating device, discharges the operating oil from the first port by opening the path between the first port and the second control valve, to lower the object.

3 Claims, 1 Drawing Sheet

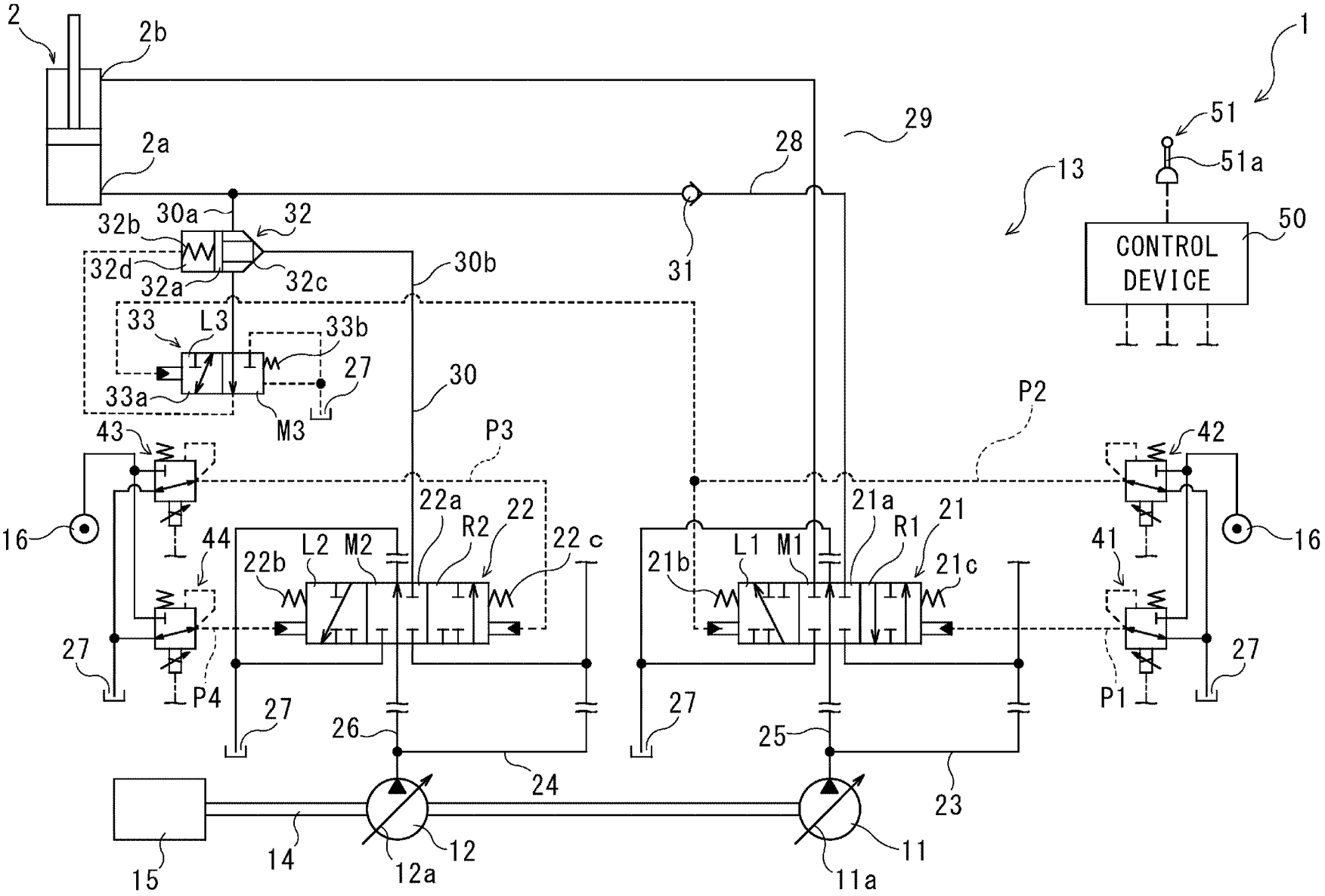
CONTROL DEVICE
1
2
2a
2b
11
11a
12
12a
13
14
15
16
21
21a
21b
21c
22
22a
22b
22 c
23
24
25
26
27
28
29
30
30a
30b
31
32
32a
32b
32c
32d
33
33a
33b
41
42
43
44
50
51
51a
L1
L2
L3
M1
M2
M3
R1
R2
P1
P2
P3
P4

HYDRAULIC DRIVE SYSTEM

TECHNICAL FIELD

The present invention relates to a hydraulic drive system that, in order to cause an actuator to raise and lower an object, supplies operating oil to the actuator.

BACKGROUND ART

Construction equipment such as an excavator includes various hydraulic actuators such as boom cylinders and arm cylinders and, by using these hydraulic actuators, moves objects, namely, booms and arms. Furthermore, the construction equipment includes a hydraulic drive system and, by using the hydraulic drive system, supplies operating oil to each hydraulic actuator, controls the direction and the flow rate of the operating oil flowing to the hydraulic actuator, and thus controls the operation of the hydraulic actuator. The hydraulic drive system including these functions includes a control valve for each actuator and, by actuating a spool of the control valve, controls the flow direction of the operating oil. In the hydraulic drive system configured as just described, there are cases where a pilot pressure to be provided to the spool of the control valve is controlled using an electromagnetic proportional control valve.

For example, at the time of actuation of a boom cylinder, when a boom operating device is pulled down to one side in a tilt direction (raising operation), a control device outputs a signal to a boom-raising electromagnetic proportional control valve in accordance with the raising operation. Consequently, a boom-raising pilot pressure is output from the raising electromagnetic proportional control valve, and the spool moves to one side in a predetermined direction, resulting in extension of the boom cylinder and leading to the boom being raised. Conversely, when the boom operating device is pulled down to the other side in the tilt direction (lowering operation), the control device outputs a signal to a lowering electromagnetic proportional control valve in accordance with the lowering operation. Consequently, a lowering pilot pressure is output from the lowering electromagnetic proportional control valve, and the spool moves to the other side in the predetermined direction, resulting in retraction of the boom cylinder and leading to the boom being lowered. In this manner, in the hydraulic drive system, the control device drives each hydraulic actuator by controlling the direction and the flow rate of the operating oil flowing to the hydraulic actuator. A system such as that disclosed in Patent Literature (PTL) 1, for example, is known as the hydraulic drive system.

CITATION LIST

Patent Literature

PTL 1: Japanese Laid-Open Patent Application Publication No. 2017-110672

SUMMARY OF INVENTION

Technical Problem

The system disclosed in PTL 1, which has a function of detecting a malfunction of an electromagnetic proportional control valve upon the occurrence of the malfunction, is configured as follows. Specifically, in the system disclosed in PTL 1, a detection line is in communication with each control valve, and when the spool of the control valve is held in a position deviated from the neutral position, the pressure on the operation detection line increases. For example, in the system disclosed in PTL 1, when the electromagnetic proportional control valve is stuck, an undesired pilot pressure that does not correspond to the amount of operation on an operating device is output, and the spool of the corresponding control valve is held in a position deviated from the neutral position. Consequently, the value of a pressure on the operation detection line becomes different from that of a pressure thereon obtained when the spool is in the neutral position, and thus it is possible to detect a stuck electromagnetic proportional control valve by comparing the correlation between the amount of operation on the operating device and the pressure on the detection line. At this time, a passage leading from an auxiliary pump to a primary pressure line of the electromagnetic proportional control valve is blocked by the control device, and thus a fail-safe is achieved.

In the system disclosed in PTL 1, when the operating device which actuates all the control valves provided with the operation detection line is in the neutral position and, for example, the electromagnetic proportional control valve which actuates an actuator for lowering an object such as a boom is stuck, lowering of the boom due to a boom cylinder being retracted under the weight of the boom is avoided. However, when a non-boom-related control valve provided with the operation detection line is in operation, it is not possible to detect an abnormality in a boom-lowering control valve. Therefore, achieving the fail-safe for boom lowering even during non-boom-related operation is desired.

Thus, an object of the present invention is to provide a hydraulic drive system capable of achieving the fail-safe even during simultaneous operation of another actuator in the case where an electromagnetic proportional control valve to be used to lower an actuator that could fall under its own weight is stuck.

Solution to Problem

A hydraulic drive system according to the present invention raises and lowers an object by supplying and discharging operating oil to and from each of two ports of an actuator and includes: a control device that outputs first to third lowering signals in accordance with a lowering operation performed on an operating device and outputs first and second raising signals in accordance with a raising operation performed on the operating device, the operation device being used to raise and lower the object; a first electromagnetic proportional control valve that outputs a first pilot pressure corresponding to the first raising signal; a second electromagnetic proportional control valve that outputs a second pilot pressure corresponding to the first lowering signal; a third electromagnetic proportional control valve that outputs a third pilot pressure corresponding to the second raising signal; a fourth electromagnetic proportional control valve that outputs a fourth pilot pressure corresponding to the second lowering signal; a fifth electromagnetic proportional control valve that is different from the fourth electromagnetic proportional control valve and outputs a fifth pilot pressure corresponding to at least the third lowering signal; first and second hydraulic pumps that dispense the operating oil; a first control valve that is connected to the first hydraulic pump and each of the two ports, is actuated in accordance with a difference between the first pilot pressure and the second pilot pressure, and when the first pilot pressure is higher than the second pilot pressure, causes the operating oil dispensed from the first hydraulic pump to be supplied to a first port and causes the operating oil to be discharged from a second port in order to raise the object, and when the second pilot pressure is higher than the first pilot pressure, causes the operating oil dispensed from the first hydraulic pump to be supplied to the second port in order to lower the object, the first port being one of the two ports, the second port being the other of the two ports; a second control valve that is connected to the second hydraulic pump and the first port, is actuated in accordance with a difference between the third pilot pressure and the fourth pilot pressure, and when the third pilot pressure is higher than the fourth pilot pressure, causes the operating oil dispensed from the second hydraulic pump to be supplied to the first port in order to raise the object, and when the fourth pilot pressure is higher than the third pilot pressure, causes the operating oil to be discharged from the first port in order to lower the object; and a lock valve that prevents the operating oil from being discharged from the first port by closing a path between the first port and the second control valve, and when the fifth pilot pressure is output, allows the operating oil to be discharged from the first port by opening the path between the first port and the second control valve, to lower the object.

According to the present invention, in the case where the lowering operation on the operating device is not performed, the fifth pilot pressure is not output from the fifth electromagnetic proportional control valve, and thus the lock valve prevents the operating oil from being discharged from the first port. In other words, even in the case where the primary side and the secondary side are unintentionally brought into communication with each other due to, for example, the valve body of the fourth electromagnetic proportional control valve to be used to lower the object being stuck and the fourth pilot pressure is output in this state, when the lowering operation on the operating device is not performed, the operating oil can be prevented from being discharged from the first port. This makes it possible to prevent the object from unintentionally falling under its own weight when the lowering operation on the operating device is not performed, in other words, possible to achieve the fail-safe even during simultaneous operation of another actuator in the case where the fourth electromagnetic proportional control valve is stuck.

When the lowering operation on the operating device is performed, the fifth pilot pressure is output from the fifth electromagnetic proportional control valve, and thus the lock valve opens the path between the first port and the second control valve. Thus, the discharge of the operating oil from the first port is allowed, and the object can be lowered in accordance with the lowering operation on the operating device.

In the above-described invention, the fifth electromagnetic proportional control valve may be the second electromagnetic proportional control valve, and fifth pilot pressure may be the second pilot pressure.

With the above-described configuration, since the second electromagnetic proportional control valve can serve as a substitute for the fifth electromagnetic proportional control valve, there is no need to additionally provide the fifth electromagnetic proportional control valve as a separate valve from the first to fourth electromagnetic proportional control valves, and thus the number of components can be reduced.

In the above-described invention, the actuator may be a boom cylinder. With the above-described configuration, a boom that is the object can be prevented from unintentionally falling under its own weight due to the fourth electromagnetic proportional control valve being stuck.

Advantageous Effects of Invention

With the present invention, in the case where the primary side and the secondary side are unintentionally brought into communication with each other due to, for example, the valve body of the fourth electromagnetic proportional control valve to be used to lower an actuator that could fall under its own weight being stuck and the fourth pilot pressure is output in this state, the fail-safe can be achieved even during simultaneous operation of another actuator.

The above object, other objects, features, and advantages of the present invention will be made clear by the following detailed explanation of preferred embodiments with reference to the attached drawings.

BRIEF DESCRIPTION OF DRAWING

The FIGURE is a circuit diagram illustrating a hydraulic circuit of a hydraulic drive system according to an embodiment of the present invention.

DESCRIPTION OF EMBODIMENTS

Hereinafter, a hydraulic drive system 1 according to an embodiment of the present invention will be described with reference to the drawings. Note that the concept of directions mentioned in the following description is used for the sake of explanation; the orientations, etc., of elements according to the present invention are not limited to these directions. The hydraulic drive system 1 described below is merely one embodiment of the present invention. Thus, the present invention is not limited to the embodiments and may be subject to addition, deletion, and alteration within the scope of the essence of the present invention.

Construction equipment such as a hydraulic excavator, a wheel loader, and a hydraulic crane includes various attachments such as a bucket and a hoist and is capable of moving up and down the attachments by raising and lowering a boom and an arm that are the object. In order to raise and lower the boom and the arm, the construction equipment includes various actuators such as a boom cylinder and an arm cylinder, and operating oil is supplied to actuate each actuator. Furthermore, the construction equipment includes the hydraulic drive system 1 such as that illustrated in the FIGURE and, by using the hydraulic drive system 1, supplies the operating oil to each actuator to actuate the actuator. Hereinafter, the configuration of the hydraulic drive system 1 included in a hydraulic excavator that is one example of the construction equipment will be described in detail.

<Hydraulic Drive System>

The hydraulic drive system 1 is connected to various actuators including not only a boom cylinder 2 and an arm cylinder for moving the arm, but also a bucket cylinder for moving the bucket, a turning motor for moving a turning body to which the boom is attached, and a traveling motor for moving a traveling device, and actuates the various actuators by supplying the operating oil thereto. Note that in the FIGURE, actuators other than the actuator (namely, the boom cylinder 2) for the boom particularly related to the hydraulic drive system 1 according to Embodiment 1 are not illustrated, and detailed description thereof will be omitted below.

More specifically, the hydraulic drive system 1 includes first and second hydraulic pumps 11, 12 and a hydraulic supply device 13. The two hydraulic pumps 11, 12 are, for example, tandem double pumps and can be driven by a shared input shaft 14. Note that the two hydraulic pumps 11, 12 do not necessarily need to be the tandem double pumps and may be parallel double pumps or may each be a separately formed single pump. Furthermore, a drive source 15 such as an engine or an electric motor is connected to the input shaft 14, and rotation of the input shaft 14 by the drive source 15 causes pressure oil to be dispensed from the two hydraulic pumps 11, 12. The two hydraulic pumps 11, 12 configured as just described are so-called variable-capacitance swash plate pumps. Specifically, the two hydraulic pumps 11, 12 include swash plates 11*a*, 12*a*, respectively, and it is possible to change the output capacity by changing the tilt angles of the swash plates 11*a*, 12*a*. Furthermore, tilt angle adjustment mechanisms not illustrated in the drawings are provided on the swash plates 11*a*, 12*a*, and the tilt angles of the swash plates 11*a*, 12*a* are changed using the tilt angle adjustment mechanisms.

The two hydraulic pumps 11, 12 including these functions are connected to a plurality of actuators including the boom cylinder 2 via the hydraulic supply device 13, and the operating oil is supplied to each of the actuators via the hydraulic supply device 13. Furthermore, the hydraulic supply device 13 can switch the direction of the operating oil that is supplied to each of the actuators and change the flow rate of the operating oil that is supplied to each of the actuators. Specifically, the drive direction of each of the actuators is switched by switching the direction of the operating oil, and the drive speed of each of the actuators is changed by changing the flow rate of the operating oil. More specifically, the hydraulic supply device 13 includes a directional control valve corresponding to each of the actuators and allows the operating oil to flow to each of the actuators by actuating the corresponding directional control valve.

In other words, the hydraulic supply device 13 includes first and second boom directional control valves 21, 22 and various directional control valves not illustrated in the drawings such as a pair of traveling directional control valves, a turning directional control valve, an arm directional control valve, and a bucket directional control valve. Each of these directional control valves corresponds to one of the two hydraulic pumps 11, 12 and is connected in parallel with the corresponding one of the hydraulic pumps 11, 12. For example, one of the traveling directional control valves, the first boom directional control valve 21, the bucket directional control valve, and the like are connected in parallel with the first hydraulic pump 11 via a first main passage 23, and the other of the traveling directional control valves, the second boom directional control valve 22, the turning directional control valve, and the arm directional control valve are connected in parallel with the second hydraulic pump 12 via a second main passage 24. Note that the boom directional control valves 21, 22, which correspond to the boom cylinder 2, the pair of traveling directional control valves, which correspond to the traveling device, the turning directional control valve, which corresponds to the turning motor, the arm directional control valve, which corresponds to the arm cylinder, and the bucket directional control valve, which corresponds to the bucket cylinder, are connected to the hydraulic pumps 11, 12.

Furthermore, the hydraulic pumps 11, 12 are connected to first and second bypass passages 25, 26, respectively, and the operating oil dispensed from the hydraulic pumps 11, 12 is discharged to a tank 27 via the first and second bypass passages 25, 26. Moreover, one of the traveling directional control valves, the first boom directional control valve 21, the bucket directional control valve, and the like are connected in series with the first bypass passage 25, and when these directional control valves are actuated, the first bypass passage 25 is closed, and the operating oil is supplied to the actuators corresponding to the directional control valves. Meanwhile, the other of the traveling directional control valves, the second boom directional control valve 22, the turning directional control valve, the arm directional control valve, and the like are connected in series with the second bypass passage 26, and when these directional control valves are actuated, the second bypass passage 26 is closed, and the operating oil is supplied to the actuators corresponding to the directional control valves. These directional control devices are actuated in accordance with the operation on the operating device (not illustrated in the FIGURE except elements for the boom directional control valves 21, 22) and adjust, with an opening area according to the amount of operation, the supply of the oil from the hydraulic pumps 11, 12 to the corresponding actuators, in other words, actuate the corresponding actuators at a drive speed corresponding to the amount of operation. Hereinafter, the directional control valves for actuating the boom particularly related to the hydraulic drive system 1 according to Embodiment 1, namely, the first and second boom directional control valves 21, 22, will be described in detail.

The first and second boom directional control valves 21, 22 are valves for controlling the operation of the boom cylinder 2 and are connected to the first and second hydraulic pumps 11, 12, respectively, as mentioned earlier. Specifically, the first boom directional control valve 21, which is one example of the first control valve, is connected to the first hydraulic pump 11 via the first main passage 23 and the first bypass passage 25. Furthermore, the first boom directional control valve 21 is connected to the boom cylinder 2 and the tank 27, switches the connection states thereof to switch the flow direction of the operating oil, and thus extends and retracts the boom cylinder 2.

More specifically, the boom cylinder 2, which is one example of the first actuator, is a double-acting cylinder and includes two ports 2*a*, 2*b*. Specifically, when the operating oil is supplied to one of the ports, namely, the head-end port 2*a* (the first port), and the operating oil is discharged from the other of the ports, namely, the rod-end port 2*b* (the second port), the boom cylinder 2 is extended. Conversely, when the operating oil is discharged from the head-end port 2*a*, the boom cylinder 2 is retracted. In the boom cylinder 2 configured as just described, the ports 2*a*, 2*b* thereof are connected to the first boom directional control valve 21 via a head-end passage 28 and a rod-end passage 29, respectively, and the first boom directional control valve 21 switches the connection points of the two passages 28, 29 to extend and retract the boom cylinder 2. The first boom directional control valve 21 including these functions is a three-function directional control valve and includes a spool 21*a*.

The spool 21*a* is capable of moving from a neutral position M1 to each of a first offset position R1 and a second offset position L1; when the spool 21*a* is in the neutral position M1, the spool 21*a* blocks all the paths between the two passages 28, 29, the first main passage 23, and the tank 27. At this time, the first bypass passage 25 is open, and the operating oil from the first hydraulic pump 11 flows downstream of the first boom directional control valve 21 (in other words, toward other directional control valves such as the bucket directional control valve) through the first bypass passage 25 accordingly. When the spool 21*a* moves to the first offset position R1, the head-end passage 28 is connected to the first main passage 23, and the rod-end passage 29 is connected to the tank 27. This causes the operating oil to be supplied to the head-end port 2*a* and be discharged from the rod-end port 2*b*, resulting in extension of the boom cylinder 2. When the spool 21*a* moves to the second offset position L1, the head-end passage 28 and the tank 27 are disconnected, and the rod-end passage 29 is connected to the first main passage 23. Thus, the operating oil is supplied to the rod-end port 2*b*, making the boom cylinder 2 retractable. Note that when the spool 21*a* is in each of the offset positions R1, L1, the first bypass passage 25 is closed, and the operating oil from the first hydraulic pump 11 is kept from being guided to the tank 27 through the first bypass passage 25. Thus, it is possible to supply the operating oil to the boom cylinder 2. Furthermore, in the hydraulic supply device 13, the first boom directional control valve 21 and the second boom directional control valve 22 are configured to cooperate with each other to extend and retract the boom cylinder 2, and second boom directional control valve 22 is configured as follows.

Specifically, the second boom directional control valve 22, which is one example of the second control valve, is a valve that extends and retracts the boom cylinder 2 in cooperation with the first boom directional control valve 21, and is connected to the second hydraulic pump 12 via the second main passage 24 and the second bypass passage 26, as mentioned above. Furthermore, the second boom directional control valve 22 is connected to the head-end port 2*a* of the boom cylinder 2 via the lock valve 32, is further connected to the tank 27, switches the connection between the second main passage 24 and the head-end port 2*a* and the opening/closing of the second bypass passage 26 to switch the flow direction of the operating oil, and thus extends the boom cylinder 2.

More specifically, the second boom directional control valve 22 is connected to the head-end port 2*a* via a merging passage 30. In other words, the merging passage 30 is connected to the head-end passage 28, and the second boom directional control valve 22 is connected to the head-end port 2*a* via the merging passage 30 and the head-end passage 28. Note that there is a check valve 31 in the head-end passage 28 so as to prevent the operating oil guided via the merging passage 30 from flowing back toward the first boom directional control valve 21. In other words, the check valve 31 allows the operating oil to flow from the first boom directional control valve 21 toward the head-end port 2*a* and prevents the operating oil from flowing from the head-end port 2*a* toward the second boom directional control valve 22.

The second boom directional control valve 22 configured as just described switches the connection between the boom merging passage 30 and the second main passage 24; when these passages are connected, the flow of the operating oil from the second hydraulic pump 12 merges with the flow of the operating oil from the first hydraulic pump 11, and thus the operating oil can be supplied to the head-end port 2*a*. The second boom directional control valve 22 including these functions is a three-function directional control valve and includes a spool 22*a*.

The spool 22*a* is capable of moving between a neutral position M2, a first offset position R2, and a second offset position L2; when the spool 22*a* is in the neutral position M2, the spool 22*a* disconnects the boom merging passage 30 and the second main passage 24. At this time, the second bypass passage 26 is open, and the operating oil from the second hydraulic pump 12 flows downstream of the second boom directional control valve 22 (in other words, toward other directional control valves such as the turning directional control valve and the arm control valve) through the second bypass passage 26. When the spool 22*a* moves to the first offset position R2, the boom merging passage 30 is connected to the second main passage 24, and the operating oil from the second hydraulic pump 12 is guided to the head-end passage 28 via the boom merging passage 30 and the lock valve 32. Consequently, in the head-end passage 28, the flow of the operating oil from the second hydraulic pump 12 merges with the flow of the operating oil from the first hydraulic pump 11, and thus a large quantity of operating oil can be guided to the head-end port 2*a*. In other words, in the hydraulic supply device 13, at the time of raising the boom, the operating oil from the two hydraulic pumps 11, 12 can merge and be guided to the boom cylinder 2. When the spool 22*a* moves to the second offset position L2, the head-end passage 28 is connected to the tank 27 via the lock valve 32. This makes it possible to discharge the operating oil in the head-end port 2*a*, enabling retraction of the boom cylinder 2. Note that when the spool 22*a* is in each of the offset positions R2, L2, the second bypass passage 26 is closed, and the operating oil from the second hydraulic pump 12 is kept from being guided to the tank 27 through the second bypass passage 26. Thus, it is possible to supply the operating oil to the boom cylinder 2.

The two boom directional control valves 21, 22 configured as just described are pilot spool valves, and the spools 21*a*, 22*a* move by receiving pilot pressures P1 to P4. Specifically, the first pilot pressure P1 and the second pilot pressure P2 act on both ends of the spool 21*a* so as to oppose each other, and the spool 21*a* moves to a position corresponding to the difference between these two pilot pressures, that is, P1−P2. For example, when the first pilot pressure P1 is higher than the second pilot pressure P2, the spool 21*a* moves to the first offset position R1, and when the second pilot pressure P2 is higher than the first pilot pressure P1, the spool 21*a* moves to the second offset position L1.

More specifically, a pair of spring members 21*b*, 21*c* are provided on the spool 21*a*, and the spring members 21*b*, 21*c* provide the biasing force against the first pilot pressure P1 and the second pilot pressure P2 to the spool 21*a*. Therefore, the spool 21*a* is maintained in the neutral position M1 by the pair of spring members 21*b*, 21*c*, and when the absolute value of the difference between the pressures, |P1−P2|, becomes greater than or equal to predetermined operating pressures corresponding to the biasing force of the spring members 21*b*, 21*c*, the spool 21*a* moves to the offset positions R1, L1. After the movement, the spool 21*a* moves through a stroke corresponding to the aforementioned difference between the pressures, P1−P2, and connects each of the passages 23, 25, 28, 29 and the tank 27 with the degree of opening corresponding to the stroke. In other words, the first boom directional control valve 21 connects each of the passages 23, 25, 28, 29 and the tank 27 with the degree of opening corresponding to the difference between the pressures, P1−P2. Thus, when the spool 21*a* is in the first offset position R1, by controlling the degree of opening between the head-end passage 28 and the main passage 23 according to the difference between the pressures, P1−P2, it is possible to adjust the flow rate of the operating oil that flows to the head-end port 2*a* (that is, meter-in control).

The third pilot pressure P3 and the fourth pilot pressure P4 act on both ends of the spool 22*a* of the second boom directional control valve 22 so as to oppose each other, and the spool 22*a* moves to a position corresponding to the difference between these two pilot pressures, that is, P3−P4.

For example, when the third pilot pressure P3 is higher than the fourth pilot pressure P4, the spool 22*a* moves to the first offset position R2, and when the fourth pilot pressure P4 is higher than the third pilot pressure P3, the spool 22*a* moves to the second offset position L2.

More specifically, a pair of spring members 22*b*, 22*c* are provided on the spool 22*a*, and the spring members 22*b*, 22*c* provide the biasing force against the third pilot pressure P3 and the fourth pilot pressure P4 to the spool 22*a*. Therefore, the spool 22*a* is maintained in the neutral position by the pair of spring members 22*b*, 22*c*, and when the absolute value of the difference between the pressures, |P3−P4|, becomes greater than or equal to predetermined operating pressures corresponding to the biasing force of the spring members 22*b*, 22*c*, the spool 22*a* moves to the offset positions R2, L2. At this time, the spool 22*a* moves through a stroke corresponding to the aforementioned difference between the pressures, P3−P4, and connects each of the passages 24, 26, 30 and the tank 27 with the degree of opening corresponding to the stroke or disconnects the passage. In other words, the second boom directional control valve 22 also connects the merging passage 30 and the tank 27 with the degree of opening corresponding to the fourth pilot pressure P4 (when P3=0). Thus, when the spool 22*a* is in the second offset position L2, by controlling the degree of opening between the merging passage 30 and the tank 27 according to the difference between the pressures, P4−P3, it is possible to adjust the flow rate of the operating oil that is discharged from the head-end port 2*a* (that is, meter-out control).

Thus, in the two boom directional control valves 21, 22, the degree of opening between each of the passages 23 to 26, 28, 29, 30 and the tank 27 which are connected to each other is controlled according to the pilot pressures P1 to P4 provided to the spools 21*a*, 22*a*. First and second electromagnetic proportional control valves 41, 42 are connected to the first boom directional control valve 21 configured as just described, in order to provide the pilot pressures P1, P2 to the spool 21*a* of the first boom directional control valve 21, and third and fourth electromagnetic proportional control valves 43, 44 are connected to the second boom directional control valve 22 in order to provide the pilot pressures P3, P4 to the spool 22*a* of the second boom directional control valve 22.

The first to fourth electromagnetic proportional control valves 41 to 44 are each connected to the pilot pump 16 (for example, a gear pump), reduce the pressure of pilot oil dispensed from the pilot pump 16, and output the pilot oil to the corresponding spools 21*a*, 22*a*. Specifically, the first pilot pressure P1 is output from the first electromagnetic proportional control valve 41 and is provided to one end of the spool 21*a*. The second pilot pressure P2 is output from the second electromagnetic proportional control valve 42 and is provided to the other end of the spool 21*a*. The third pilot pressure P3 is output from the third electromagnetic proportional control valve 43 and is provided to one end of the spool 22*a*. The fourth pilot pressure P4 is output from the fourth electromagnetic proportional control valve 44 and is provided to the other end of the spool 22*a*. Note that the electromagnetic proportional control valves 41 to 44 are electromagnetic proportional valves of the direct proportional type and output the pilot pressures P1 to P4 having values corresponding to signals (for example, electric currents or voltages) input to the electromagnetic proportional control valves 41 to 44. The electromagnetic proportional control valves 41 to 44 configured as just described are connected to a control device 50 in order to control the operation of the electromagnetic proportional control valves 41 to 44.

The control device 50 outputs the signals to the electromagnetic proportional control valves 41 to 44 in order to control the operation of the electromagnetic proportional control valves 41 to 44. A boom operating device 51 is electrically connected to the control device 50. The boom operating device 51, which is one example of the operating device, is, for example, an electric joystick or a hydraulic operation valve and is used to operate the boom. The hydraulic operation valve includes a pressure sensor for detecting an operating pressure and outputs, to the control device 50, an electric signal corresponding to the amount of operation. More specifically, the boom operating device 51 includes an operating lever 51*a* and is configured so that the operating lever 51*a* can be pulled down to one side and the other side in a predetermined tilt direction. Furthermore, the boom operating device 51 outputs, to the control device 50, signals corresponding to the direction and extent of tilting of the operating lever 51*a*, and the control device 50 outputs the signals to the electromagnetic proportional control valves 41 to 44 according to the signals received from the boom operating device 51.

More specifically, when the operating lever 51*a* is pulled down to one side in the tilt direction in order to raise the boom (in other words, the raising operation is performed), the control device 50 outputs, to the first electromagnetic proportional control valve 41 and the third electromagnetic proportional control valve 43, first and second raising signals having values (specifically, electric current values or voltage values) corresponding to the extent of tilting of the operating lever 51*a* on the basis of the signals output from the boom operating device 51. Accordingly, the pilot pressures P1, P3 are output from the first and third electromagnetic proportional control valves 41, 43, and the hydraulic pressures of the two hydraulic pumps 11, 12 are guided to the head-end port 2*a* via the first and second boom directional control valves 21, 22. Thus, the boom cylinder 2 is extended, and the boom is raised. Conversely, when the operating lever 51*a* is pulled down to the other side in the tilt direction in order to lower the boom (in other words, the lowering operation is performed), the control device 50 outputs, to the second and fourth electromagnetic proportional control valves 42, 44, first and second lowering signals having values (specifically, electric current values or voltage values) corresponding to the extent of tilting of the operating lever 51*a* on the basis of the signals output from the boom operating device 51. Accordingly, the pilot pressures P2, P4 are output from the second and fourth electromagnetic proportional control valves 42, 44, respectively. Consequently, the operating oil in the first hydraulic pump 11 is supplied to the rod-end port 2*b* via the first boom directional control valve 21, and the operating oil in the head-end port 2*a* is discharged to the tank 27 via the second boom directional control valve 22. This causes the boom cylinder 2 to be retracted, allowing the boom to be lowered.

The hydraulic supply device 13 configured as just described further includes the lock valve 32 in order to hold the boom in place. The lock valve 32 is located in the merging passage 30 and configured to allow opening and closing of the merging passage 30. More specifically, the lock valve 32 includes a plunger 32*a* and a spring member 32*b*. The plunger 32*a* closes the merging passage 30 by moving to a closed position at which the plunger 32*a* is seated on a valve seat 32*c*, and opens the merging passage 30 by moving to an open position at which the plunger 32*a* is lifted off the valve seat 32*c*. The spring member 32*b* is provided on the plunger 32*a* which moves as just described; the spring member 32*b* biases the plunger 32*a* in a direction in which the plunger 32*a* is seated on the valve seat 32*c*, namely, a closing direction. Furthermore, the following pressure acts on the plunger 32*a* to oppose the biasing force of the spring member 32*b*.

Specifically, the lock valve 32 is located in the merging passage 30, as mentioned above, and the merging passage 30 includes: a port-end section 30*a* located on the head-end port 2*a* side of the lock valve 32; and a valve-end section 30*b* located on the second boom directional control valve 22 side of the lock valve 32. The plunger 32*a* is under the hydraulic pressures of these port-end section 30*a* and valve-end section 30*b* in a direction opposing the biasing force of the spring member 32*b*, namely, an opening direction in which the plunger 32*a* is lifted off the valve seat 32*c*. Furthermore, a pilot chamber (spring chamber) 32*d* is formed in the lock valve 32, and the plunger 32*a* is under the hydraulic pressure of the pilot chamber 32*d* in a direction opposing the hydraulic pressures of the port-end section 30*a* and the valve-end section 30*b*, namely, the closing direction. Furthermore, a selective valve 33 is connected to the pilot chamber 32*d* of the lock valve 32.

The selective valve 33 is a two-function directional switch valve and includes a spool 33*a*. The spool 33*a* moves between a neutral position M3 and an offset position L3. The spool 33*a* at the neutral position M3 connects the pilot chamber 32*d* of the lock valve 32 to the port-end section 30*a* of the merging passage 30. This causes the plunger 32*a* to close the merging passage 30. When the spool 33*a* moves to the offset position L3, the pilot chamber 32*d* is connected to the tank 27, and the hydraulic pressure of the pilot chamber 32*d* matches the tank pressure. Thus, the force pushing the plunger 32*a* in the opening direction becomes greater than the force pushing the plunger 32*a* in the closing direction, and the plunger 32*a* moves in the opening direction, resulting in the merging passage 30 being opened.

In this manner, the selective valve 33 is capable of opening and closing the merging passage 30 by moving the spool 33*a* of the selective valve 33 and changing the hydraulic pressure of the pilot chamber 32*d*. A spring member 33*b* is provided on the spool 33*a* of the selective valve 33 including these functions, and the spool 33*a* is biased to the neutral position M3 using the spring member 33*b*. Furthermore, the second pilot pressure P2 acts on the spool 33*a* so as to oppose the biasing force of the spring member 33*b*, and when the second pilot pressure P2 higher than or equal to a predetermined release pressure Pb, which is determined according to the biasing force of the spring member 33*b*, acts on the spool 33*a*, the spool 33*a* moves from the neutral position M3 to the offset position L3. The second electromagnetic proportional control valve 42 is connected to the spool 33*a* configured as just described, in order to provide the second pilot pressure P2 to the spool 33*a*.

The spool 21*a* of the first boom directional control valve 21 is connected to the second electromagnetic proportional control valve 42, which also serves as the fifth electromagnetic proportional control valve, as mentioned above, and in addition, the spool 33*a* of the selective valve 33 is connected in parallel with the first boom directional control valve 21. In other words, when the second lowering signal, which also serves as the third lowering signal, is input to the second electromagnetic proportional control valve 42, the second electromagnetic proportional control valve 42 outputs the second pilot pressure P2 (equivalent to the fifth pilot pressure) to the spool 33*a* in addition to the spool 21*a*. Therefore, when the operating lever 51*a* is pulled down to the other side in the tilt direction in order to lower the boom, the spool 33*a* moves to the offset position L3, allowing the plunger 32*a* of the lock valve 32 to move to the open position. Thus, the merging passage 30 is opened, allowing the operating oil to be discharged from the head-end port 2*a* to the tank 27 via the second boom directional control valve 22. Thus, even when the lock valve 32 is located midway, the boom cylinder 2 can be retracted, allowing the boom to be lowered.

When the operating lever 51*a* is pulled down to one side in the tilt direction and the second raising signal is output from the control device 50 to the third electromagnetic proportional control valve 43, the third electromagnetic proportional control valve 43 outputs the third pilot pressure P3, and the spool 22*a* of the second boom directional control valve 22 moves to the first offset position R2. Accordingly, the valve-end section 30*b* of the merging passage 30 and the second main passage 24 are connected, and an operating fluid from the second hydraulic pump 12 is guided to the valve-end section 30*b*. As with an ordinary check valve, a hydraulic pressure that is guided to the pilot chamber 32*d* of the lock valve 32 is lower than a hydraulic pressure at the port-end section 30*a* by a value corresponding to a pressure reduced upon passing outside the plunger 32*d*, and thus the passage 30 is opened. This allows the operating oil to flow from the first boom directional control valve 21 to the head-end port 2*a*; even when there is the lock valve 32 in the head-end passage 28, the operating oil from the two hydraulic pumps 11, 12 can merge and be guided to the head-end port 2*a*. In other words, the boom cylinder 2 can be extended, allowing the boom to be raised.

Furthermore, in the case where the operating lever 51*a* is not operated, the control device 50 does not output the second lowering signal, and the second pilot pressure P2 is substantially zero. Therefore, the spool 33*a* of the selective valve 33 is maintained in the neutral position M3, and the hydraulic pressure of the port-end section 30*a* is guided to the pilot chamber 32*d* of the lock valve 32. Thus, the plunger 32*a* moves to the closed position, and the merging passage 30 is closed. The head-end passage 28 is also closed by the check valve 31, and thus the path between the head-end port 2*a* and the first and second boom directional control valves 21, 22 is completely blocked, and the operating oil is prevented from being discharged from the head-end port 2*a*. Therefore, the boom can be held in place in the case where the operating lever 51*a* is not operated. In the hydraulic drive system 1 configured as describe above, when the fourth electromagnetic proportional control valve 44 malfunctions and is stuck with a valve body thereof bringing the primary side and the secondary side into communication with each other or when the fourth pilot pressure P4 is output due to a malfunction of an electrical system, the fourth pilot pressure P4 always acts on the spool 22*a* of the second boom directional control valve 22. With this, the spool 22*a* of the second boom directional control valve 22 is held in the second offset position L2. This results in constant connection of the merging passage 30 to the tank 27; in this state, the hydraulic drive system 1 achieves the following fail-safe.

Specifically, in the case where the operating lever 51*a* is not operated, the control device 50 does not output the second lowering signal, and thus the closed state of the merging passage 30 is maintained, as mentioned earlier. Therefore, in the case where the operating lever 51*a* is not operated, even when the fourth electromagnetic proportional control valve 44 is stuck with the valve body thereof bringing the primary side and the secondary side into communication with each other or when a secondary pressure is unintentionally generated due to a malfunction of an electrical system, the operating oil in the head-end port 2*a* is not discharged. This means that the boom can be held in place and it is possible to prevent the boom from unintentionally falling under its own weight. Thus, the hydraulic drive system 1 is capable of achieving the fail-safe even during simultaneous operation of another actuator (in other words, during operation of another operating device) when a secondary pressure is unintentionally generated due to, for example, the valve body of the fourth electromagnetic proportional control valve 44 being stuck.

Furthermore, when the second electromagnetic proportional control valve 42 is stuck with a valve body thereof bringing the primary side and the secondary side into communication with each other, the fail-safe is achieved as follows. Specifically, in the head-end passage 28, the flow back to the tank 27 is prevented by the check valve 31. Furthermore, the lock valve 32 in the merging passage 30 is unlocked, but the spool 22*a* of the second boom directional control valve 22 is in the neutral position M2 and thus, the second boom directional control valve 22 disconnects the merging passage 30 and the tank 27. Therefore, even when the second electromagnetic proportional control valve 42 is stuck with the valve body thereof bringing the primary side and the secondary side into communication with each other, the fail-safe can be achieved.

When the operating lever 51*a* is pulled down to the other side in the tilt direction in order to lower the boom, the second lowering signal is input to the second electromagnetic proportional control valve 42, and the second pilot pressure P2 is output from the second electromagnetic proportional control valve 42 to the spool 33*a* of the selective valve 33. With this, the spool 33*a* moves to the offset position L3, and the pilot chamber 32*d* of the lock valve 32 is brought into communication with the tank 27 accordingly. Thus, the port-end section 30*a* and the valve-end section 30*b* of the merging passage 30 are in communication as long as the pressure of the merging passage 30 is higher than or equal to a pressure corresponding to the spring. Therefore, the discharge of the operating oil from the head-end port 2*a* to the tank 27 is allowed, and the boom can be lowered.

Other Embodiments

The foregoing describes the hydraulic drive system 1 according to the present embodiment applied to a hydraulic excavator, but the subject to which this is applicable is not limited to the hydraulic excavator. Specifically, the hydraulic drive system 1 may be applied to construction equipment such as hydraulic cranes and wheel loaders and construction vehicles such as forklifts. Furthermore, the hydraulic drive system 1 according to the present embodiment raises and lowers the boom, but the object to be raised and lowered is not limited to the boom and may be an arm, a hook of a hoist, and the like. In these cases, the actuator is an arm cylinder and a hoist motor.

Furthermore, in the hydraulic drive system 1 according to the present embodiment, the second electromagnetic proportional control valve 42 is also used as an electromagnetic proportional control valve for providing the pilot pressure to the spool 33*a* of the selective valve 33, but these do not necessarily need to be used in this shared manner; a separate valve may be additionally provided. Moreover, in the hydraulic drive system 1 according to the present embodiment, the first to fourth electromagnetic proportional control valves 41 to 44 are formed separately from the first and second boom directional control valves 21, 22, but these do not necessarily need to be in such a form. Specifically, the first to fourth electromagnetic proportional control valves 41 to 44 may be formed integrally with the first and second boom directional control valves 21, 22, and the form thereof is not limited.

From the foregoing description, many modifications and other embodiments of the present invention would be obvious to a person having ordinary skill in the art. Therefore, the foregoing description should be interpreted only as an example and is provided for the purpose of teaching the best mode for carrying out the present invention to a person having ordinary skill in the art. Substantial changes in details of the structures and/or functions of the present invention are possible within the spirit of the present invention.

REFERENCE SIGNS LIST

1 hydraulic drive system
2 boom cylinder (actuator)
2*a* head-end port (first port)
2*b* rod-end port (second port)
11 first hydraulic pump
12 second hydraulic pump
21 first boom directional control valve (first control valve)
22 second boom directional control valve (second control valve)
32 lock valve
41 first electromagnetic proportional control valve
42 second electromagnetic proportional control valve (fifth electromagnetic proportional control valve)
43 third electromagnetic proportional control valve
44 fourth electromagnetic proportional control valve
50 control device
51 boom operating device (operating device)

The invention claimed is:

1. A hydraulic drive system for raising and lowering an object by supplying and discharging operating oil to and from each of two ports of an actuator, the hydraulic drive system comprising:

a control device that outputs first to third lowering signals in accordance with a lowering operation performed on an operating device and outputs first and second raising signals in accordance with a raising operation performed on the operating device, the operation device being used to raise and lower the object;

a first electromagnetic proportional control valve that outputs a first pilot pressure corresponding to the first raising signal;

a second electromagnetic proportional control valve that outputs a second pilot pressure corresponding to the first lowering signal;

a third electromagnetic proportional control valve that outputs a third pilot pressure corresponding to the second raising signal;

a fourth electromagnetic proportional control valve that outputs a fourth pilot pressure corresponding to the second lowering signal;

a fifth electromagnetic proportional control valve that is different from the fourth electromagnetic proportional control valve and outputs a fifth pilot pressure corresponding to at least the third lowering signal;

first and second hydraulic pumps that dispense the operating oil;

a first control valve that is connected to the first hydraulic pump and each of the two ports, is actuated in accordance with a difference between the first pilot pressure and the second pilot pressure, and when the first pilot pressure is higher than the second pilot pressure, causes the operating oil dispensed from the first hydraulic pump to be supplied to a first port and causes the operating oil to be discharged from a second port in order to raise the object, and when the second pilot pressure is higher than the first pilot pressure, causes the operating oil dispensed from the first hydraulic pump to be supplied to the second port in order to lower the object, the first port being one of the two ports, the second port being the other of the two ports;

a second control valve that is connected to the second hydraulic pump and the first port, is actuated in accordance with a difference between the third pilot pressure and the fourth pilot pressure, and when the third pilot pressure is higher than the fourth pilot pressure, causes the operating oil dispensed from the second hydraulic pump to be supplied to the first port in order to raise the object, and when the fourth pilot pressure is higher than the third pilot pressure, causes the operating oil to be discharged from the first port in order to lower the object; and a lock valve that prevents the operating oil from being discharged from the first port by closing a path between the first port and the second control valve, and when the fifth pilot pressure is output, allows the operating oil to be discharged from the first port by opening the path between the first port and the second control valve, to lower the object.

2. The hydraulic drive system according to claim 1, wherein:

the actuator is a boom cylinder.

3. A hydraulic drive system for raising and lowering an object by supplying and discharging operating oil to and from each of two ports of an actuator, the hydraulic drive system comprising:

a control device that outputs first and second lowering signals in accordance with a lowering operation performed on an operating device and outputs first and second raising signals in accordance with a raising operation performed on the operating device, the operation device being used to raise and lower the object;

a first electromagnetic proportional control valve that outputs a first pilot pressure corresponding to the first raising signal;

a second electromagnetic proportional control valve that outputs a second pilot pressure corresponding to the first lowering signal or the second lowering signal;

a third electromagnetic proportional control valve that outputs a third pilot pressure corresponding to the second raising signal;

a fourth electromagnetic proportional control valve that outputs a fourth pilot pressure corresponding to the second lowering signal;

first and second hydraulic pumps that dispense the operating oil;

a first control valve that is connected to the first hydraulic pump and each of the two ports, is actuated in accordance with a difference between the first pilot pressure and the second pilot pressure, and when the first pilot pressure is higher than the second pilot pressure, causes the operating oil dispensed from the first hydraulic pump to be supplied to a first port and causes the operating oil to be discharged from a second port in order to raise the object, and when the second pilot pressure is higher than the first pilot pressure, causes the operating oil dispensed from the first hydraulic pump to be supplied to the second port in order to lower the object, the first port being one of the two ports, the second port being the other of the two ports;

a second control valve that is connected to the second hydraulic pump and the first port, is actuated in accordance with a difference between the third pilot pressure and the fourth pilot pressure, and when the third pilot pressure is higher than the fourth pilot pressure, causes the operating oil dispensed from the second hydraulic pump to be supplied to the first port in order to raise the object, and when the fourth pilot pressure is higher than the third pilot pressure, causes the operating oil to be discharged from the first port in order to lower the object; and a lock valve that prevents the operating oil from being discharged from the first port by closing a path between the first port and the second control valve, and when the second pilot pressure is output, allows the operating oil to be discharged from the first port by opening the path between the first port and the second control valve, to lower the object, wherein even when the fourth pilot pressure is output, the lock valve keeps the path between the first port and the second control valve closed such that the object is prevented from being lowered unless the second pilot pressure is output, wherein the lock valve opens and closes the path between the first port and the second control valve by a selective valve changing a hydraulic pressure of a pilot chamber of the lock valve; and the selective valve changes the hydraulic pressure of the pilot chamber according to the second pilot pressure provided to the selective valve.

* * * * *